US008414410B1

(12) United States Patent
Flaherty et al.

(10) Patent No.: US 8,414,410 B1
(45) **Date of Patent: *Apr. 9, 2013**

(54) CLUB HEAD WITH CLUB HEAD ALIGNMENT AID AND RELATED METHOD

(75) Inventors: Kevin W. Flaherty, Phoenix, AZ (US); John H. Loudenslager, Phoenix, AZ (US); Nicholas S. Radeleff, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/536,760

(22) Filed: Jun. 28, 2012

Related U.S. Application Data

(63) Continuation of application No. 13/345,541, filed on Jan. 6, 2012.

(60) Provisional application No. 61/558,977, filed on Nov. 11, 2011, provisional application No. 61/576,350, filed on Dec. 15, 2011, provisional application No. 61/558,977, filed on Nov. 11, 2011, provisional application No. 61/576,350, filed on Dec. 15, 2011.

(51) Int. Cl.
*A63B 69/36* (2006.01)

(52) U.S. Cl.
USPC ..... 473/219; 473/231; 473/238; 473/242; 473/252

(58) Field of Classification Search ..... 473/219–256; D21/733, 735, 746, 751, 759
See application file for complete search history.

(56) References Cited

U.S. PATENT DOCUMENTS

| | | | | | |
|---|---|---|---|---|---|
| 1,660,126 | A | * | 2/1928 | Heeter | 473/242 |
| D89,332 | S | * | 2/1933 | Bartsch | D21/733 |
| 2,842,369 | A | * | 7/1958 | East | 473/242 |
| 2,859,972 | A | | 11/1958 | Reach | |
| 2,934,347 | A | | 4/1960 | Siniscalchi | |
| 3,680,860 | A | * | 8/1972 | Elkins, Jr. | 473/409 |
| D231,624 | S | | 5/1974 | Wilmoth | |
| 3,884,477 | A | | 5/1975 | Bianco | |
| 3,888,484 | A | | 6/1975 | Zitko | |
| D240,751 | S | * | 7/1976 | Taylor | D21/734 |
| D241,957 | S | | 10/1976 | Melton | |
| 4,157,830 | A | * | 6/1979 | Taylor et al. | 473/242 |

(Continued)

OTHER PUBLICATIONS

Dave Allen, Driver: Cobra Ferrari: Rev your engine, fellas-this driver is built for top speeds, Golf Magazine, Aug. 2012, at pp. 94-95.

(Continued)

*Primary Examiner* — Sebastiano Passaniti

(57) ABSTRACT

A driver club head can include a front end having a front face, a toe end, a heel end opposite the toe end, a rear end opposite the front end, a crown surface having a front crown end and a rear crown end, and an alignment aid at the crown surface. The front crown end can be closer to the front end than to the rear end, and the rear crown end can be closer to the rear end than to the front end. The alignment aid can include two or more alignment aid stripes. The two or more alignment aid stripes can include a first alignment aid stripe and a second alignment aid stripe extending between the front crown end and the rear crown end. Other embodiments are also disclosed.

20 Claims, 10 Drawing Sheets

U.S. PATENT DOCUMENTS

| | | | | | |
|---|---|---|---|---|---|
| 4,174,839 | A | * | 11/1979 | Marrs | 473/252 |
| 4,222,566 | A | | 9/1980 | Berry | |
| 4,832,344 | A | | 5/1989 | Werner | |
| 4,962,931 | A | * | 10/1990 | Jazdzyk, Jr. | 473/252 |
| 5,324,031 | A | | 6/1994 | Green | |
| 5,505,448 | A | | 4/1996 | Park | |
| 5,690,556 | A | * | 11/1997 | Condon | 473/252 |
| D401,991 | S | * | 12/1998 | Collins | D21/744 |
| 6,039,657 | A | * | 3/2000 | Gidney | 473/252 |
| 6,062,986 | A | | 5/2000 | Kaise | |
| D437,624 | S | | 2/2001 | Tate | |
| 6,379,258 | B1 | * | 4/2002 | To | 473/242 |
| 7,077,757 | B1 | | 7/2006 | Payne et al. | |
| 7,828,669 | B1 | | 11/2010 | Stites | |
| 7,955,180 | B2 | | 6/2011 | Bittner | |
| 7,959,519 | B2 | * | 6/2011 | Zielke et al. | 473/249 |
| 2005/0192114 | A1 | * | 9/2005 | Zider et al. | 473/251 |
| 2008/0015045 | A1 | | 1/2008 | Payne et al. | |
| 2010/0304878 | A1 | | 12/2010 | Reichow et al. | |
| 2010/0323806 | A1 | | 12/2010 | Stites | |
| 2011/0081982 | A1 | | 4/2011 | Stites | |

OTHER PUBLICATIONS

Ely Callaway, Golf Putter | Odyssey White Ice 2-Ball Lined Putters | Odyssey Golf; 2001, Product Overview, http://shop.callawaygolf.com/putters-white-ice-2-ball-lined-2011/putters-white-ice-2-ball.

PureShot Driver by ExcitoGolf; http://excitogolf.com/pureshotdriver.html.

GolfWeek Comp Issue Jun. 1, 2012 Ferrari Cobra Driver, at p. 6; <http://www.mydigitalpublication.com/publication/?i=113547&p=&pn=>.

Ferrari adds aerodynamics and style to create a collectible Cobra driver; <http://www.golf.com/equipment/ferrari-adds-aerodynamics-and-style-create-collectible-cobra-driver>.

* cited by examiner

CLUB HEAD WITH CLUB HEAD ALIGNMENT AID AND RELATED METHOD

CROSS-REFERENCE TO RELATED APPLICATIONS

This application claims the benefit of U.S. Provisional Application No. 61/558,977, filed Nov. 11, 2011, and U.S. Provisional Application No. 61/576,350, filed Dec. 15, 2011. Further, this application is a continuation of U.S. Non-Provisional application Ser. No. 13/345,541, filed Jan. 6, 2012, which also claims the benefit of U.S. Provisional Application No. 61/558,977 and U.S. Provisional Application No. 61/576,350. U.S. Non-Provisional application Ser. No. 13/345,541, U.S. Provisional Application No. 61/558,977, and U.S. Provisional Application No. 61/576,350 are each incorporated herein by reference in their entirety.

TECHNICAL FIELD

This disclosure relates generally to sports equipment, and relates more particularly to club heads and related methods.

BACKGROUND

Ensuring that the strike face of a golf club contacts a golf ball squarely and that the strike face follows through squarely can increase the distance, speed, and/or accuracy of the trajectory of the golf ball. The size of the golf balls and the strike face of a golf club can make it difficult to align the strike face and/or club head of the golf club with the golf balls.

BRIEF DESCRIPTION OF THE DRAWINGS

To facilitate further description of the embodiments, the following drawings are provided in which.

Figure 1:
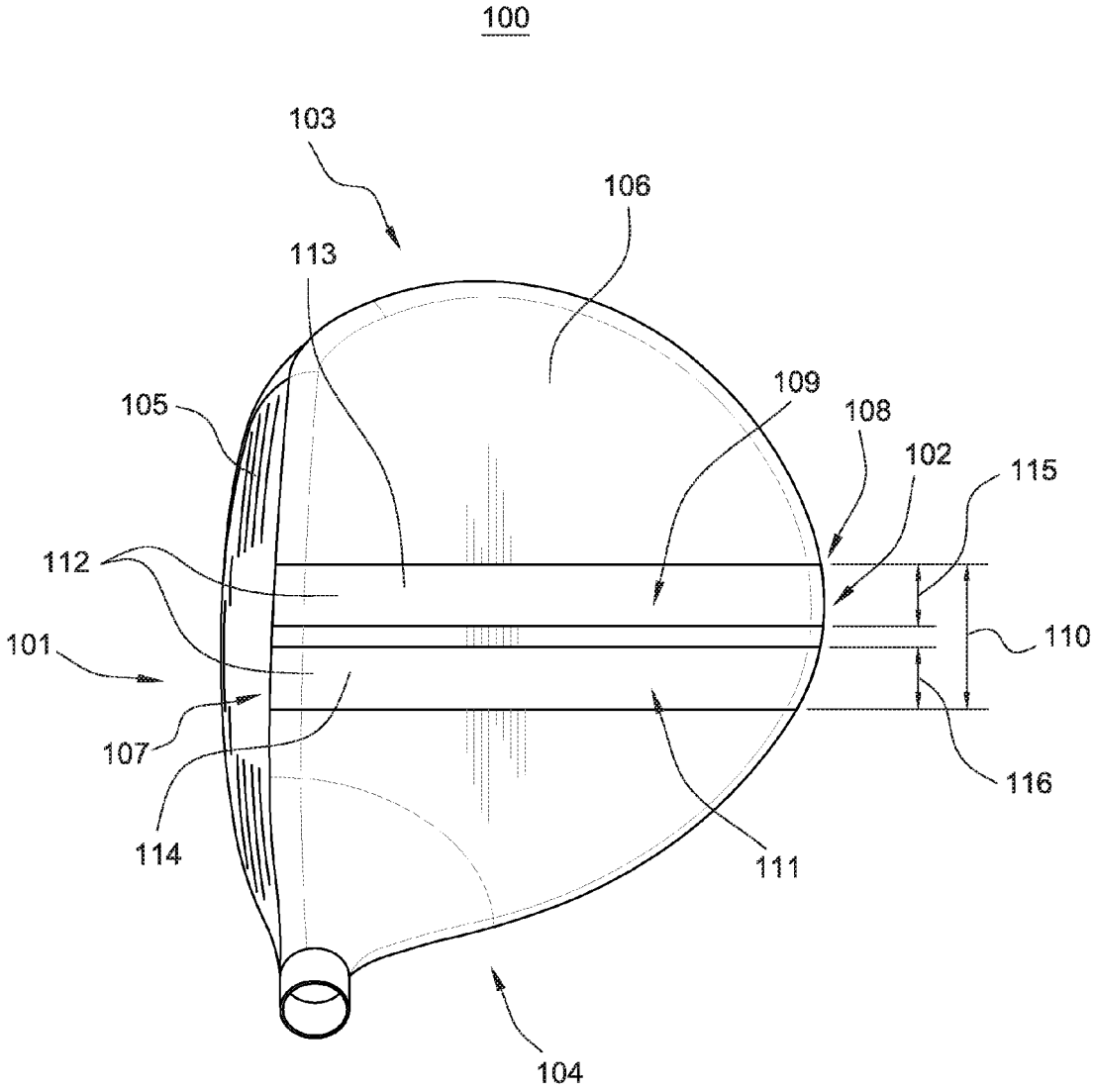
FIG. 1 illustrates a top view of an exemplary club head, according to an embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more mechanical elements may be mechanically coupled together, but not be electrically or otherwise coupled together. Coupling may be for any length of time, e.g., permanent or semi-permanent or only for an instant.

"Electrical coupling" and the like should be broadly understood and include coupling involving any electrical signal, whether a power signal, a data signal, and/or other types or combinations of electrical signals. "Mechanical coupling" and the like should be broadly understood and include mechanical coupling of all types.

The absence of the word "removably," "removable," and the like near the word "coupled," and the like does not mean that the coupling, etc. in question is or is not removable.

DETAILED DESCRIPTION OF EXAMPLES OF EMBODIMENTS

Some embodiments include a club head comprising a front end where the front end comprises a front face. The club head also comprises a toe end, a heel end opposite the toe end, and a rear end opposite the front face. Meanwhile, the club head comprises a crown surface comprising a front crown end, and a rear crown end, and an alignment aid at the crown surface extending between the front crown end and the rear crown end. The front crown end is closer to the front end than to the rear ends, and the rear crown end is closer to the rear end than to the front end.

Various embodiments include a club head comprising a front end where the front end comprises a front face. The club head comprises a toe end, a heel end opposite the toe end, and a rear end opposite the front face. Meanwhile, the club head comprises a crown surface comprising a front crown end, and a rear crown end, and an alignment aid at the crown surface extending from the front crown end to the rear crown end. The front crown end is closer to the front end than to the rear end, and the rear crown end is closer to the rear end than to the front end. The club head can comprise one of a driver club head, a fairway wood club head, or a hybrid club head. The alignment aid comprises an alignment aid width, and the alignment aid width can be approximately equal to a golf ball diameter. Furthermore, the alignment aid can comprise three alignment aid stripes, and the three alignment aid stripes can comprise a toe alignment aid stripe, a heel alignment aid stripe, and a center alignment aid stripe. The toe alignment aid stripe is closer to the toe end than to the heel end; the heel alignment aid stripe is closer to the heel end than to the toe end; and the center alignment aid stripe is between the toe alignment aid stripe and the heel alignment aid stripe. Likewise, the toe alignment aid stripe comprises a toe alignment aid stripe width; the heel alignment aid stripe comprises a heel alignment aid stripe width; and the center alignment aid stripe comprises a center alignment aid stripe width. The toe alignment aid stripe width can be approximately equal to the heel alignment aid stripe width, and the center alignment aid stripe width is wider than the toe alignment aid stripe width and the heel alignment aid stripe width. The toe alignment stripe, the heel alignment aid stripe, and the center alignment aid stripe can be parallel with each other and orthogonal to the front face. The center alignment aid stripe width is wider than the toe alignment aid stripe width and the heel alignment aid stripe width. The toe alignment aid stripe can be offset from the center alignment aid stripe, and/or the heel alignment aid stripe can be offset from the center alignment aid stripe.

Further embodiments include a method comprising: providing a club head comprising a front end comprising a front face; a toe end and a heel end opposite the toe end, a rear end opposite the front face, and a crown surface comprising a front crown end and a rear crown end, where the front crown end is closer to the front end than to the rear end and the rear crown end is closer to the rear end than to the front end; and providing an alignment aid at the crown surface such that the alignment aid extends between the front crown end and the rear crown end.

Some embodiments include a club head comprising a front end comprising a front face The club head also comprises a toe end, a heel end opposite the toe end, and a rear end opposite the front face. Meanwhile, the club head comprises a crown surface comprising a front crown end and a rear crown end. The club head also comprises an alignment aid at the crown surface extending between the front crown end and the rear crown end. The front crown end can be closer to the front end than to the rear end, the rear crown end can be closer to the rear end than to the front end, and the alignment aid can indicate a type of club head of the club head.

Various embodiments include a club head comprising a front end comprising a front face. The club head also comprises a toe end, a heel end opposite the toe end, and a rear end opposite the front face. Meanwhile, the club head further comprises a crown surface comprising a front crown end and a rear crown end. The club head also comprises an alignment aid extending across the crown surface from the front crown end to the rear crown end. The club head can comprise a driver club head. The alignment aid can comprise four alignment aid stripes. The alignment aid can comprise an alignment aid width, and the alignment aid width can be approximately equal to a golf ball diameter. The four alignment aid stripes can comprise a first toe alignment aid stripe, a first heel alignment aid stripe, a second toe alignment aid stripe, and a second heel alignment aid stripe. The first toe alignment aid stripe can be closer to the toe end than to the heel end, the first heel alignment aid stripe can be closer to the heel end than to the toe end, the second toe alignment aid stripe can be closer to the toe end than the first toe alignment aid stripe, and the second heel alignment aid stripe can be closer to the heel end than the first heel alignment aid strip. The first toe alignment aid stripe can comprise a first toe alignment aid stripe width, the first heel alignment aid stripe can comprise a first heel alignment aid stripe width, and the first toe alignment aid stripe width can be approximately equal to the first heel alignment aid stripe width. Meanwhile, the second toe alignment aid stripe can comprise a second toe alignment aid stripe width, the second heel alignment aid stripe can comprise a second heel alignment aid stripe width, and the second toe alignment aid stripe width can be approximately equal to the second heel alignment aid stripe width. The first toe alignment aid stripe, the first heel alignment aid stripe, the second toe alignment aid stripe, and the second heel alignment aid strip can be approximately parallel with each other. The second toe alignment aid stripe width can be narrower than the first toe alignment aid stripe width, and the second heel alignment aid stripe width can be narrower than the first heel alignment aid stripe width. Further still, the first toe alignment aid stripe can be offset from the second toe alignment aid stripe by a toe offset region, the first heel alignment aid stripe is offset from the second heel alignment aid stripe by a heel offset region, the toe offset region can comprise a toe offset region width, the heel offset region can comprise a heel offset region width, and the toe offset region width can be approximately equal to heel offset region width. Likewise, the first toe alignment aid stripe can be offset from the first heel alignment aid stripe by a center offset region, the center offset region can comprise a center offset region width, and the toe offset region width and the heel offset region width can be narrower than the center offset region width. The alignment aid can be orthogonal with the front face.

Further embodiments include a method. The method comprises providing a club head. The club head comprises a front end comprising a front face. The club head also comprises a toe end and a heel end opposite the toe end, and a rear end opposite the front face. Meanwhile, the club head further comprises a crown surface comprising a front crown end and a rear crown end, where the front crown end is closer to the front end than to the rear end and the rear crown end is closer to the rear end than to the front end. The method can also comprise providing an alignment aid at the crown surface and extending between the front crown end and the rear crown end, where the alignment aid indicates a type of club head of the club head.

Some embodiments include a driver club head. The drive club head comprises a front end. The front end comprises a front face. The driver club head also comprises a toe end, a heel end opposite the toe end, a rear end opposite the front end, and a crown surface. The crown surface comprises a front crown end and a rear crown end. Further, the driver club head comprises an alignment aid at the crown surface. The front crown end can be closer to the front end than to the rear end. Meanwhile, the rear crown end can be closer to the rear end than to the front end. The alignment aid can comprise two or more alignment aid stripes. The two or more alignment aid stripes can comprise a first alignment aid stripe and a second alignment aid stripe extending between the front crown end and the rear crown end. The first alignment aid stripe can be closer to the toe end than to the heel end, and the second alignment aid stripe can be closer to the heel end than to the toe end. The first alignment aid stripe can be approximately parallel with the second alignment aid stripe. Further, the first alignment aid stripe can be offset from the second alignment aid stripe by a gap. The two or more alignment aid stripes can comprise a first color, and the crown surface can comprise a second color different from the first color. The gap can comprise the second color.

Various embodiments include a wood-type club head. The wood-type club head can comprise a front end. The front end comprises a front face. The wood-type club head also comprises a toe end, a heel end opposite the toe end, a rear end opposite the front end, and a crown surface. The crown surface comprises a front crown end and a rear crown end. Further, the wood-type club head can comprise an alignment aid at the crown surface and between the front crown end and the rear crown end. The front crown end can be closer to the front end than to the rear end, and the rear crown end can be closer to the rear end than to the front end. Further, the alignment aid can comprise two or more alignment aid stripes, and the two or more alignment aid stripes can be offset from each other by a gap and can be non-collinear. The two or more alignment aid stripes can comprise a first color, the crown surface can comprise a second color different from the first color, and the gap can comprise the second color.

Further embodiments include a wood-type club head. The wood-type club head comprises a front end. The front end comprises a front face. The wood-type club head also comprises a toe end, a heel end opposite the toe end, a rear end opposite the front face, and a crown surface. The crown surface comprises a front crown end and a rear crown end. Further, the wood-type club head comprises an alignment aid at the crown surface and between the front crown end and the rear crown end. The front crown end can be closer to the front end than to the rear end, and the rear crown end can be closer to the rear end than to the front end. Further, the alignment aid can comprise an alignment aid width, and the alignment aid width can be less than or equal to a golf ball diameter of a golf ball. The alignment aid can comprise two or more alignment aid stripes, and the two or more alignment aid stripes can be approximately parallel with each other.

Turning to the drawings, FIG. 1 illustrates a top view of club head 100, according to an embodiment. Club head 100 is merely exemplary and is not limited to the embodiments presented herein. Club head 100 can be employed in many different embodiments or examples not specifically depicted or described herein.

Club head 100 can comprise any suitable wood-type golf club head (e.g., a driver club head, a fairway wood club head, a hybrid club head, etc.). In many embodiments, club head 100 can comprise a metal wood golf club head, but club head 100 can comprise any other suitable material. In various embodiments, club head 100 can be hollow.

Referring to FIG. 1, club head 100 comprises front end 101, and front end 101 comprises front face 105. Front face 105 can refer to a striking face and/or striking plate of club head 100. Club head 100 comprises rear end 102 opposite of front face 105. Club head 100 also comprises toe end 103 and heel end 104 opposite of toe end 103.

Meanwhile, club head 100 comprises crown surface 106. Crown surface 106 comprises front crown end 107, rear crown end 108, and alignment aid 109. Crown surface 106 can extend from front face 105 toward rear end 102, such as, for example, at a top end of club head 100. Accordingly, in many embodiments, crown surface 106 can be bounded by front face 105, rear end 102, toe end 103, and heel end 104 at the top end of club head 100.

Likewise, club head 100 can comprise a skirt surface adjacent to crown surface 106. Similar to crown surface 106, the skirt surface can extend from front face 105 toward rear end 102. Accordingly, in various embodiments, the skirt surface can be bounded by front face 105, rear end 102, toe end 103, and heel end 104.

In some embodiments, crown surface 106 and/or the skirt surface can be curved and/or beveled into and/or toward rear end 102, toe end 103, and/or heel end 104 at the boundary of crown surface 106 and/or rear end 102, toe end 103, and/or heel end 104, respectively. In one embodiment, alignment aid 109 is located only at crown surface 106. In a different embodiment, however, alignment aid 109 is located at crown surface 106 and at other portion(s) of club head 100. For example, alignment aid 109 can be located at crown surface 106 and at one or more of (a) the skirt surface that is between crown surface 106 and the sole of club head 100, or (b) the curved and/or beveled surface between crown surface 106 and front face 105.

Front crown end 107 is closer to front end 101 than to rear end 102, and rear crown end 108 is closer to rear end 102 than to front end 101. For example, front crown end 107 can refer to a line or region demarcating where front face 105 meets crown surface 106. Meanwhile, rear crown end 108 can refer to a line or region demarcating where crown surface 106 meets the skirt surface of club head 100 at rear end 102. However, in other embodiments, front crown end 107 can refer to any line or region of crown surface 106 that is closer to front end 101 than to rear end 102, and rear crown end 108 can refer to any line or region of crown surface 106 that is closer to rear end 102 than to front end 101.

Alignment aid 109 can extend between front crown end 107 and rear crown end 108 across crown surface 106. In some embodiments, front face 105 and/or the skirt surface of club head 100 can also comprise alignment aid 109. Accordingly, in these embodiments, alignment aid 109 can also extend across front face 105, across the skirt surface at rear crown end 102, and/or across the sole of club head 100. Thus, where alignment aid 109 extends across front face 105 and the skirt surface, alignment aid 109 can extend entirely around club head 100 to form a closed loop. Meanwhile, alignment aid 109 can extend only part of the way across crown surface 106, such as, for example, where front crown end 107 and/or rear crown end 108 refer to line(s) and/or region(s) of crown surface 106 other than the line(s) and/or region(s) demarcating the interfaces of front face 105 with crown surface 106 and of crown surface 106 with the skirt surface of club head 100, respectively. Still, in many embodiments, front crown end 107 and/or rear crown end 108 can refer to line(s) and/or region(s) of crown surface 106 demarcating the interfaces of front face 105 with crown surface 106 and crown surface 106 with the skirt surface of club head 100, respectively. Accordingly, in embodiments of club head 100 where the outer boundary of crown surface 106, front face 105, and/or the skirt surface are beveled and/or curved, alignment aid 109 can extend through the bevel and/or curvature (a) to the interface of front face 105 with crown surface 106, and/or (b) to the interface of crown surface 106 with the skirt surface, and/or vice versa, as applicable. In any event, alignment aid 109 can be configured such that user(s) of club head 100 can see alignment aid 109 (e.g., while looking downward from above club head 100) when using club head 100 (e.g., a golf club comprising club head 100) and/or when club head 100 is at the address position.

Alignment aid 109 can indicate to user(s) the location of the center of club face 105 between toe end 103 and heel end 104, and/or can provide confirmation to user(s) that club head 100 is aligned to strike a golf ball in a desired manner. For example, alignment aid 109 can indicate a portion of a swing path for club head 100 that is perpendicular to front face 105 (e.g., such that front face 105 squarely addresses a golf ball when striking the golf ball), such as, for example, the initial takeaway portion of a golf club back swing.

Alignment aid 109 can comprise alignment aid width 110. In many embodiments, alignment aid width 110 can remain substantially constant as alignment aid 109 extends across crown surface 106, front face 105, and/or the skirt surface of club head 100. In many embodiments, alignment aid width 110 can be approximately equal to a golf ball diameter (e.g., greater than or equal to approximately 4.26 centimeters). In this manner, alignment aid 109 can precisely be aligned with the edges of a golf ball in order to ensure square contact with the golf ball. In other embodiments, alignment aid width 110 can be greater or less than the golf ball diameter.

Although alignment aid 109 can comprise any suitable graphic for aligning club head 100 with a golf ball, in many embodiments, alignment aid 109 can comprise one or more alignment aid stripes 111 (e.g., two alignment aid stripes, three alignment aid stripes, four alignment aid stripes, fives alignment aid stripes, six alignment aid stripes, seven alignment aid stripes, eight alignment aid stripes, nine alignment aid stripes, etc.). Alignment aid 109 can also indicate the type of club head of club head 100. For example, alignment aid 109 can be configured to indicate a driver club head, a fairway wood club head, or a hybrid club head. As another example, alignment aid 109 can be configured to resemble racing stripes or another suitable indicia of the race car industry to convey an impression of high speed, long distance, power, etc.

Racing stripes can effectively indicate alignment without distracting user(s) of club head 100. Implementing alignment aid stripe(s) 111 as multiple alignment aid stripes can permit improved visualization of alignment aid 109 to align front face 105 with a golf ball. Still, the number of alignment aid stripes can also be limited in order to avoid over stimulating (e.g., distracting) user(s) of club head 100. Accordingly, in some embodiments, implementing alignment aid 109 can entail finding a desirable number of alignment aid stripes by which to permit aligning front face 105 with a golf ball without over cluttering crown surface 106. In general, whether or not alignment aid 109 comprises stripes, alignment aid 109 can appear to be substantially linear.

Meanwhile, for example, the racing stripes of alignment aid 109 can also indicate that club head 100 is a driver club head, such as by providing an association of the golf term "driver" with that of a race car "driver." In another example, alignment aid 109 can comprise a graphic of a tall tree or group of trees configured to resemble a forest. Accordingly, when club head 100 comprises a fairway wood club head, alignment aid 109 can comprise the graphic of the tall tree or the group of trees to provide an association of the golf term "fairway wood" with "woods" of a forest. Meanwhile, the tree(s) can be illustrated in such a manner that the tree trunk(s) can indicate alignment for swinging club head 100. Other examples can implement any other suitable graphic such as a corporate logo, a brand logo, a trademark, or a trade name.

In many embodiments, alignment aid stripe(s) 111 can comprise varying widths and/or be configured offset from each other to place emphasis on certain alignment aid stripes (e.g., thicker alignment aid stripes) of alignment aid stripe(s) 111, as described in further detail below with respect to various examples that more clearly articulate these concepts. Any of the width(s) of alignment aid stripe(s) 111 and/or the width(s) of the offset(s) between alignment aid stripe(s) 111 can be determined according to one or more ratios of the width(s) of alignment aid stripe(s) 111 and/or the width(s) of the offset(s) to one another. In some embodiments, these ratios can be determined so as to avoid configurations of alignment aid 109 that would cause crown surface 106 to appear cluttered and/or to distract rather than aid the user(s). Meanwhile, alignment aid stripe(s) 111 can comprise different attributes (e.g., different colors and/or surface finishes) (a) from each other and/or (b) from front face 105, crown surface 106, and/or the skirt surface of club head 100, in order (i) to permit distinction of one alignment aid stripe of alignment aid stripe(s) 111 from another and/or (ii) to permit distinction of alignment aid 109 from front face 105, crown surface 106, and/or the skirt surface of club head 100. This implementation can be employed, for example, where alignment aid stripe(s) 111 are flush with each other rather than offset or spaced apart from each other.

Accordingly, in many examples, alignment aid stripe(s) 111 can comprise two alignment aid stripes 112, providing two distinct points of reference for user(s) of club head 100. Two alignment aid stripes 112 can comprise toe alignment aid stripe 113 and heel alignment aid stripe 114. In these embodiments, toe alignment aid stripe 113 is closer to toe end 103 than to heel end 104, and heel alignment aid stripe 114 is closer to heel end 104 than to toe end 103.

Toe alignment aid stripe 113 comprises toe alignment aid stripe width 115, and heel alignment aid stripe 114 comprises heel alignment aid stripe width 116. In many embodiments, toe alignment aid stripe width 115 can be approximately equal to heel alignment aid stripe width 116. In some embodiments, toe alignment aid stripe 113 can be offset from heel alignment aid stripe width 116. In other embodiments, toe alignment aid stripe 113 can be flush with heel alignment aid stripe 114. In these other embodiments, toe alignment aid stripe 113 and heel alignment aid stripe 114 can comprise different colors to permit user(s) of club head 100 to identify toe alignment aid stripe 113 and heel alignment aid stripe 114 from each other. Toe alignment aid stripe 113 can be parallel with heel alignment aid stripe 114.

In some embodiments, toe alignment aid stripe 113 can be offset from heel alignment aid stripe 114 by a distance less than toe alignment aid stripe width 115 and/or heel alignment aid stripe width 116. In this manner, toe alignment aid stripe 113 and/or heel alignment aid stripe 114 can be emphasized such that an offset stripe formed by offsetting toe alignment aid stripe 113 from heel alignment aid stripe 114 can operate as a peripheral point of reference compared to toe alignment aid stripe 113 and heel alignment aid stripe 114, which could operate as primary points of reference in these embodiments. The opposite emphasis can result by offsetting heel alignment aid stripe 114 from toe alignment aid stripe 113 by a distance greater than toe alignment aid stripe width 115 and/or heel alignment aid stripe width 116.

Figure 2:
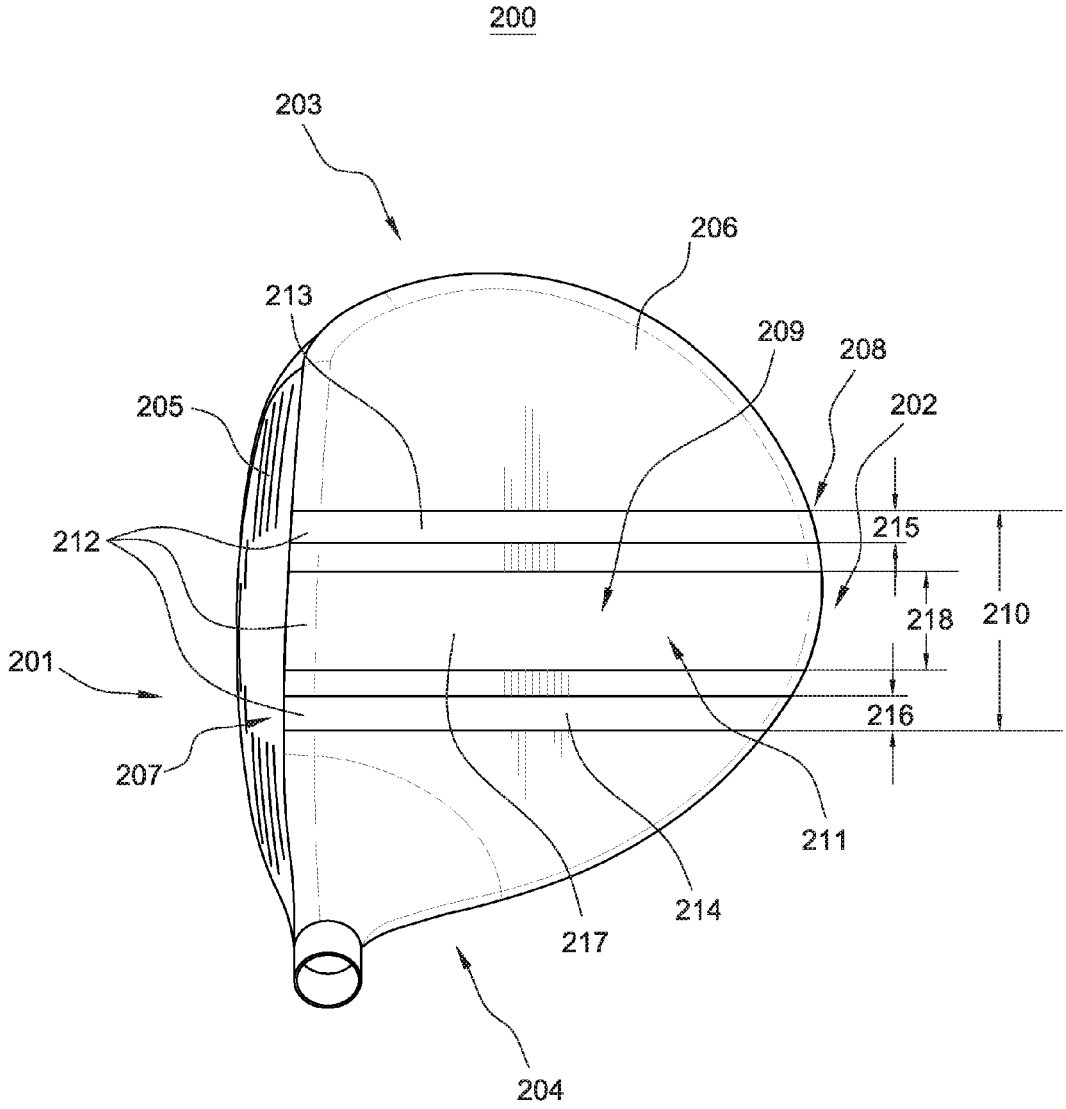
FIG. 2 illustrates a top view of another exemplary club head having an alignment aid of three stripes, according to another embodiment.

Turning to the next drawing, FIG. 2 illustrates a top view of an exemplary club head 200 where alignment aid stripe(s) 211 comprise three alignment aid stripes 212, according to an embodiment. Club head 200 can be similar to club head 100 (FIG. 1). Accordingly, like numbered reference elements of club head 200 can be similar or identical to like numbered reference elements of club head 100.

Club head 200 can comprise front end 201 and rear end 202. Likewise, club head 200 can also comprise front crown end 207 and rear crown end 208.

Three alignment aid stripes 212 can comprise toe alignment aid stripe 213, heel alignment aid stripe 214, and center alignment aid stripe 217. Toe alignment aid stripe 213 is closer to toe end 203 than to heel end 204; heel alignment aid stripe 214 is closer to heel end 204 than to toe end 203; and center alignment aid stripe 217 is between toe alignment aid stripe 213 and heel alignment aid stripe 214.

Toe alignment aid stripe 213 comprises toe alignment aid stripe width 215, heel alignment aid stripe 214 comprises heel alignment aid stripe width 216, and center alignment aid stripe 217 comprises center alignment aid stripe width 218. In some embodiments, center alignment aid stripe width 218 can be wider than toe alignment aid stripe width 215 and heel alignment aid stripe width 216. For example, toe alignment aid stripe width 215 and heel alignment aid stripe width 216 can each be approximately 0.762 centimeters, and center alignment aid stripe width 218 can be approximately 1.88 centimeters. In these or other embodiments, toe alignment aid stripe width 215 can be approximately equal to heel alignment aid stripe width 216. In other embodiments, center alignment aid stripe width 218 can be more narrow than toe alignment aid stripe width 215 and heel alignment aid stripe width 216.

Similar to the two alignment aid stripes in FIG. 1, whether center alignment aid stripe width 218 is wider or more narrow than toe alignment aid stripe width 215 and heel alignment aid stripe width 216 can be based on whether it is desirable to emphasize (a) toe alignment aid stripe width 213 and heel alignment aid stripe width 214 or (b) center alignment aid stripe 217. More specifically, where center alignment aid stripe width 218 is wider than toe alignment aid stripe width 215 and heel alignment aid stripe width 216, center alignment aid stripe 217 can be emphasized, and toe alignment aid stripe 213 and heel alignment aid stripe 214 can operate as peripheral points of reference. Meanwhile, where center alignment aid stripe width 218 is more narrow than toe alignment aid stripe width 215 and heel alignment aid stripe width 216, center alignment aid stripe 217 can operate as the peripheral point of reference, and toe alignment aid stripe 213 and heel alignment aid stripe 214 can operate as primary points of reference. Emphasizing center alignment aid stripe 217 over toe alignment aid stripe 213 and heel alignment aid stripe 214 can focus more of the user's attention on aligning alignment aid 209 with a golf ball via center alignment aid stripe 217 while still providing toe alignment aid stripe 213 and heel alignment aid stripe 214 to emphasize the boundaries of alignment aid 209 (and to align the boundaries to the outer perimeter of a golf ball).

Also similar to the two alignment stripes in FIG. 1, toe alignment stripe 213, heel alignment aid stripe 214, and center alignment aid stripe 217 can be parallel with one or more other ones of toe alignment stripe 213, heel alignment aid stripe 214, and/or center alignment aid stripe 217. Implementing toe alignment stripe 213, heel alignment aid stripe 214, and center alignment aid stripe 217 to be parallel with one another can emphasize the striking path simulated by alignment aid 209.

Toe alignment aid stripe 213 and/or heel alignment aid stripe 214 can be offset from center alignment aid stripe 217, by the same extent or by different extents, as applicable. For example, toe alignment aid stripe 213 and heel alignment aid stripe 214 can each be offset from center alignment aid stripe 217 by 0.432 centimeters. In these examples, toe alignment aid stripe 213 can be separate from heel alignment aid stripe 214 by 0.864 centimeters in addition to center alignment aid stripe width 218 (e.g., 1.88 centimeters). Accordingly, in these examples, alignment aid width 210 can be approximately 4.26 centimeters, which is the approximate diameter of a golf ball. Offsetting toe alignment aid stripe 213 and/or heel alignment aid stripe 214 from center alignment aid stripe 217 can frame and further emphasize toe alignment aid stripe 213, heel alignment aid stripe 214, and center alignment aid stripe 217. In other examples, toe alignment aid stripe 213 and/or heel alignment aid stripe 214 can be flush with center alignment aid stripe 217. In these embodiments, toe alignment aid stripe 213 and/or heel alignment aid stripe 214 can comprise different colors or surface finishes than center alignment aid stripe 217 to permit toe alignment aid stripe 213 and/or heel alignment aid stripe 214 to be distinguished from center alignment aid stripe 217.

Referring now to both FIG. 1 and FIG. 2, alignment aid 109 and/or alignment aid 209 can be orthogonal with front face 105 and/or front face 205, respectively, such as, for example, to indicate a portion of a swing path that will cause front face 105 and/or front face 205 to strike a golf ball squarely. Meanwhile, in other embodiments, alignment aid 309 (FIG. 3) and/or alignment aid 409 (FIG. 4) can be angled with respect to front face 305 (FIG. 3) and/or front face 405 (FIG. 4), respectively, as described below.

Figure 3:
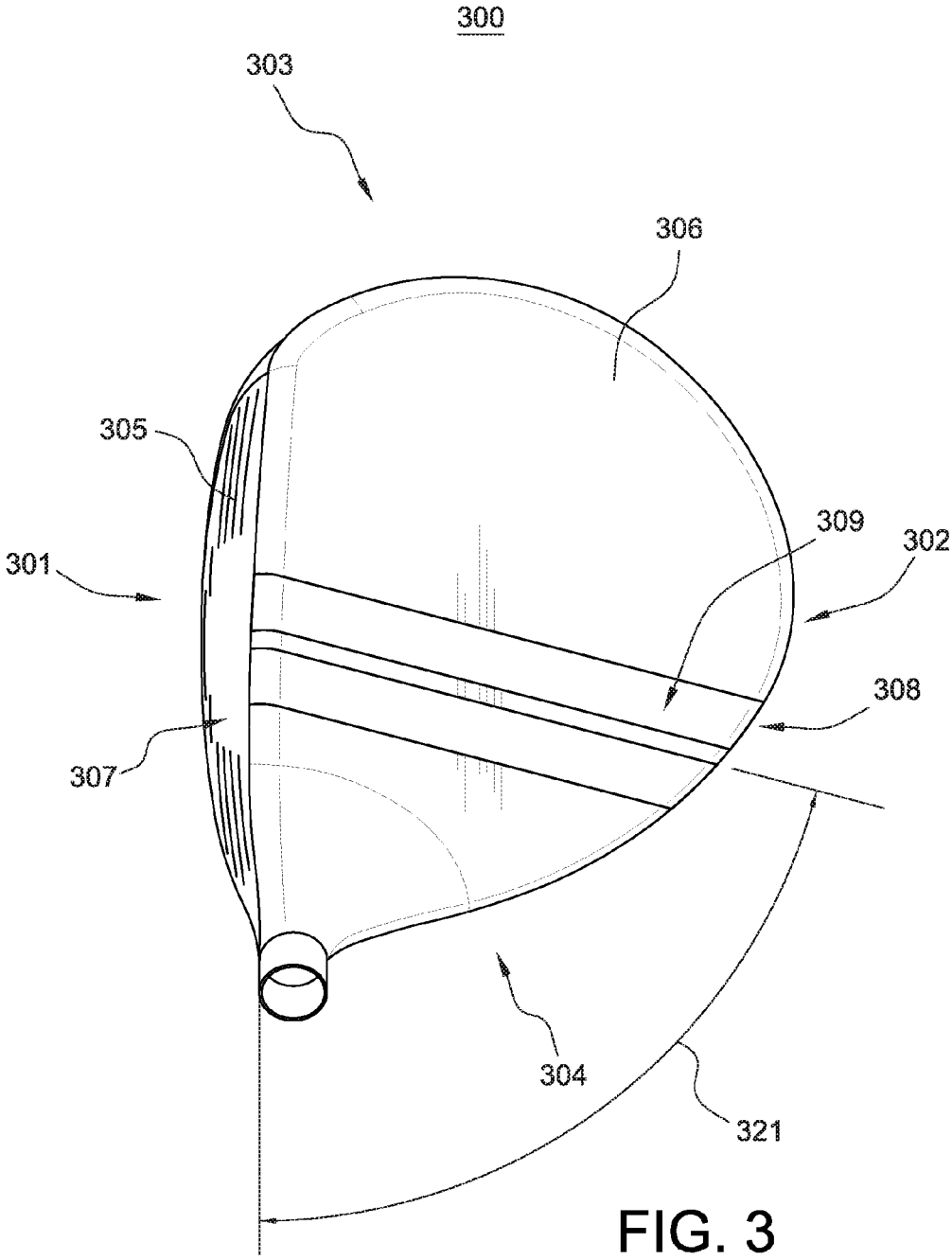
FIG. 3 illustrates a top view of another club head having an alignment aid forming an acute angle with a front face of the club head, where the acute angle opens toward a heel end of the club head, according to another embodiment.

For example, FIG. 3 illustrates club head 300 where alignment aid 309 forms acute angle 321 with front face 305 that opens and/or biases toward heel end 304, according to an embodiment. Club head 300 can be similar to club head 100 (FIG. 1) and/or club head 200 (FIG. 2) such that like numbered reference elements in FIG. 3 can be similar or identical to like numbered elements in FIGS. 1 and 2. Accordingly, club head 300 can comprise front end 301, rear end 302, toe end 303, and heel end 304. Likewise, club head 300 can comprise front crown end 307 and rear crown end 308. Meanwhile, alignment aid 309 (FIG. 3) can form acute angle 321 (e.g., greater than or equal to approximately 45 degrees and less than approximately 90 degrees) with front face 305, as illustrated in FIG. 3. Acute angle 321 (FIG. 3) can open and/or bias toward heel end 304.

Figure 4:
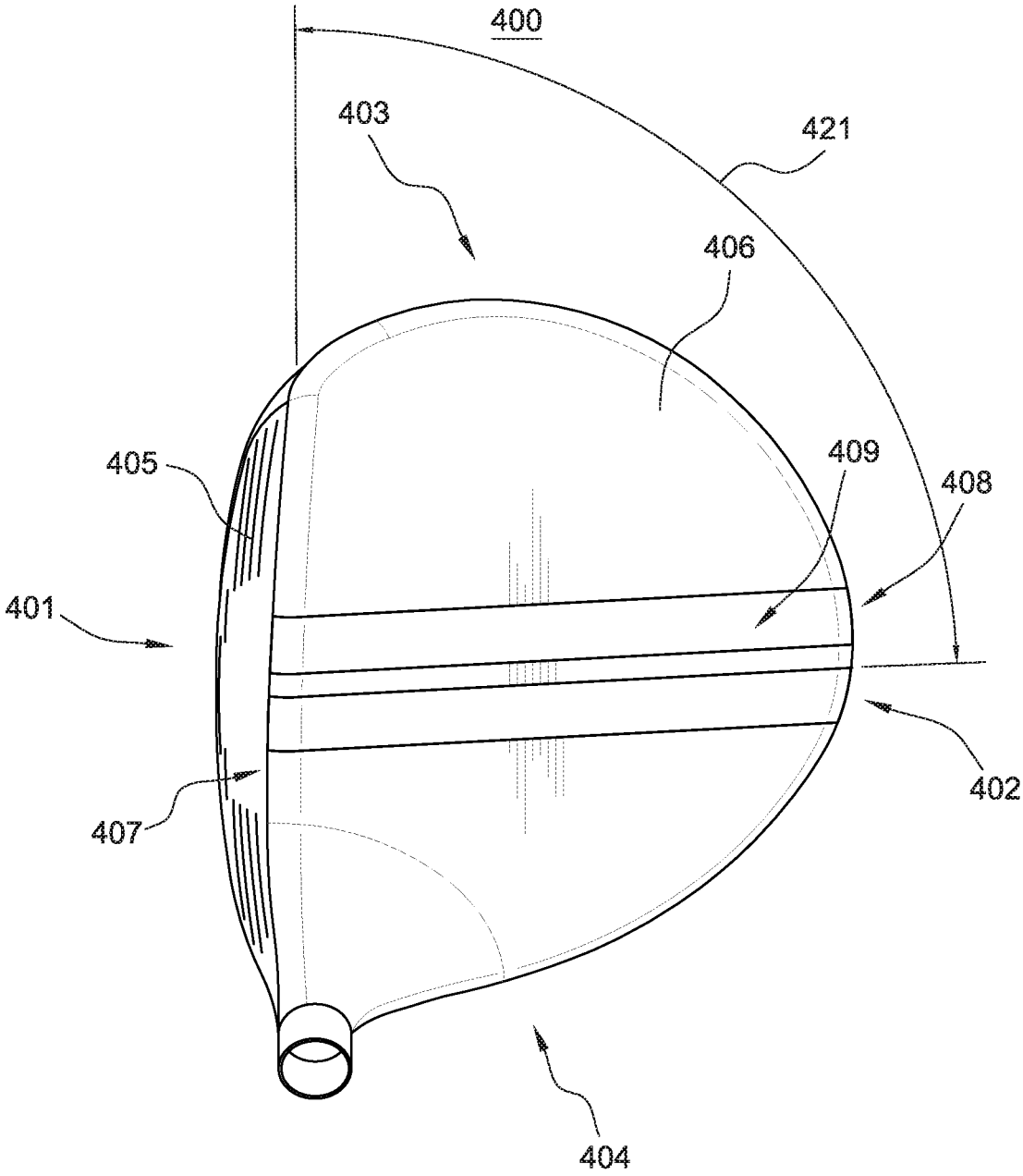
FIG. 4 illustrates a top view of another club head having an alignment aid forming an acute angle with a front face of the club head, where the acute angle opens toward a toe end of the club head, according to another embodiment.

In other embodiments, FIG. 4 illustrates club head 400 where alignment aid 409 forms acute angle 421 with front face 405 that opens and/or biases toward toe end 403, according to the embodiment of FIG. 1. Club head 400 can be similar to club head 100 (FIG. 1) and/or club head 200 (FIG. 2) such that like numbered reference elements in FIG. 4 can be similar to like numbered elements in FIGS. 1 and 2. Club head 400 can comprise front end 401, rear end 402, toe end 403, and heel end 404. Likewise, club head 400 can comprise front crown end 407 and rear crown end 408. Meanwhile, alignment aid 409 can form acute angle 421 (e.g., greater than or equal to approximately 45 degrees and less than approximately 90 degrees) with front face 405, as illustrated in FIG. 4. Acute angle 421 (FIG. 4) can open and/or bias toward toe end 403.

Figure 5:
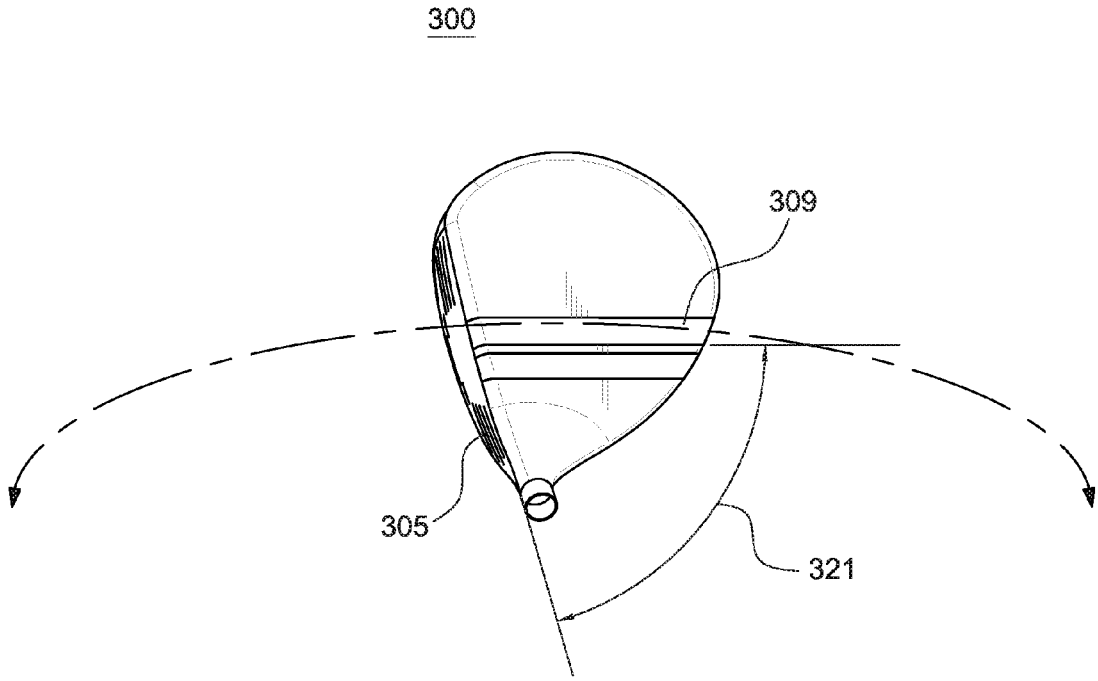
FIG. 5 illustrates a top view of the club head of FIG. 3 while in operation without using the alignment aid of the club head, according to the embodiment of FIG. 3.
Figure 6:
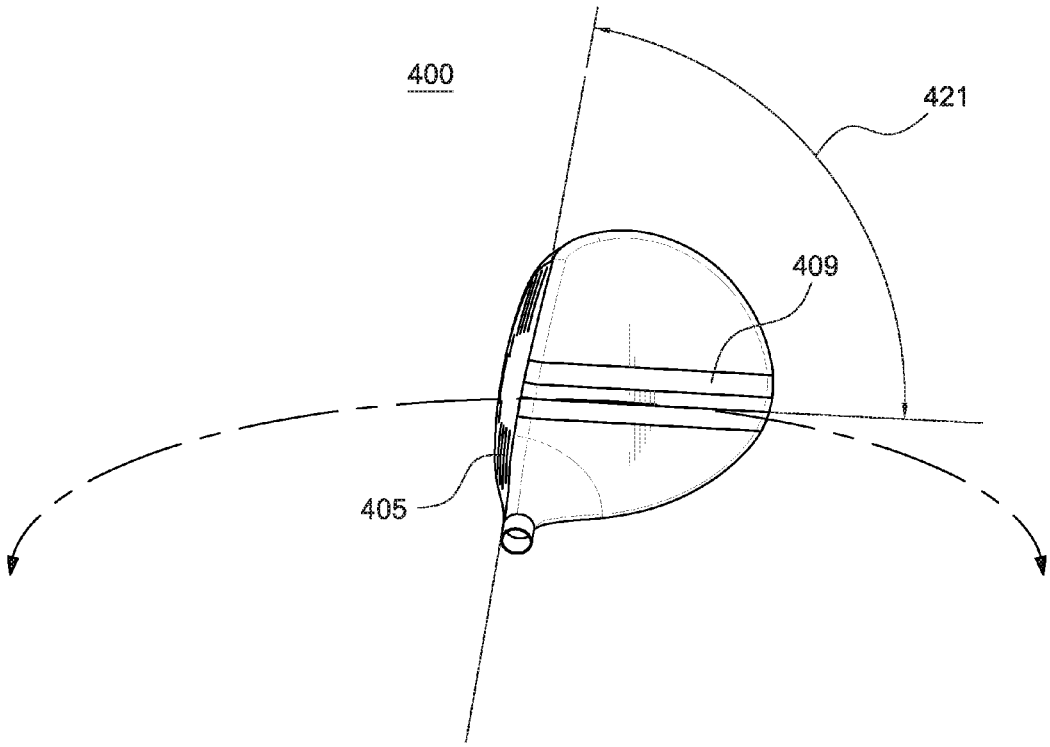
FIG. 6 illustrates a top view of the club head of FIG. 3 while in operation and while using the alignment aid of the club head, according to the embodiment of FIG. 3.

Referring to FIG. 3 and FIG. 4, by angling alignment aid 309 to form acute angle 321 (FIG. 3) and/or by angling alignment aid 409 to form acute angle 421 (FIG. 4), alignment aid 309 and/or alignment aid 409 can assist user(s) of club heads 300 and/or 400 that have known undesirable tendencies in their golf swing. For example, if user(s) tend to leave the club head too far "open" when contacting front face 305 with a golf ball, angling alignment aid 309 to form acute angle 321 (FIG. 3) can remind and/or suggest to the user(s) to "close" club face 305, as illustrated at FIG. 5. Thus, FIG. 5 illustrates exemplary club head 300 with alignment aid 309 forming acute angle 321 with club face 305 while in operation without using alignment aid 309, according to the embodiment of FIG. 3. In other examples, if user(s) tend to leave the club head too far "closed" when contacting front face 405 with a golf ball, angling alignment aid 409 to form acute angle 421 (FIG. 4) can remind and/or suggest to the user(s) to "open" club face 405, as illustrated in FIG. 6. For example, FIG. 6 illustrates exemplary club head 400 with alignment aid 409 forming acute angle 421 with club face 405 while in operation and while using alignment aid 409, according to the embodiment of FIG. 4. The magnitude of acute angle 321 (FIG. 3 and FIG. 5) and/or acute angle 421 (FIG. 4 and FIG. 6) can be a function of the degree to which the particular user(s) of club head 100 need to correct their swing(s) in order to strike front face 305 and/or front face 405 squarely with a golf ball.

Figure 7:
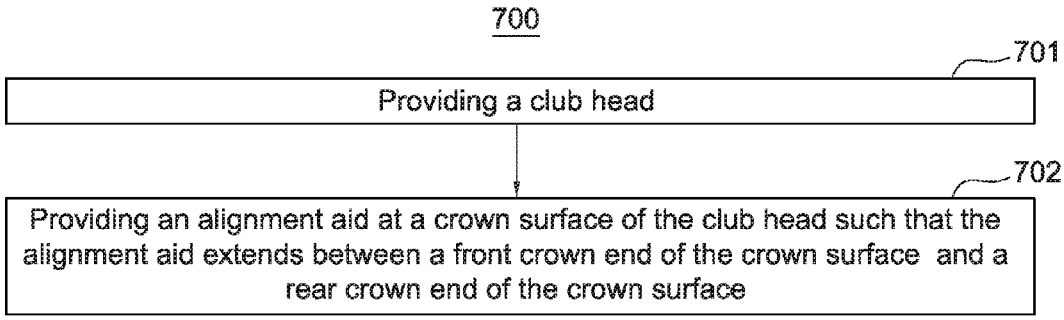
FIG. 7 illustrates a flow chart for an embodiment of a method related to the club heads of FIGS. 1-6.

Turning to the next drawing, FIG. 7 illustrates a flow chart for an embodiment of method 700. Method 700 is merely exemplary and is not limited to the embodiments presented herein. Method 700 can be employed in many different embodiments or examples not specifically depicted or described herein. In some embodiments, the procedures, the processes, and/or the activities of method 700 can be performed in the order presented. In other embodiments, the procedures, the processes, and/or the activities of the method 700 can be performed in any other suitable order. In still other embodiments, one or more of the procedures, the processes, and/or the activities in method 700 can be combined or skipped.

Figure 11:
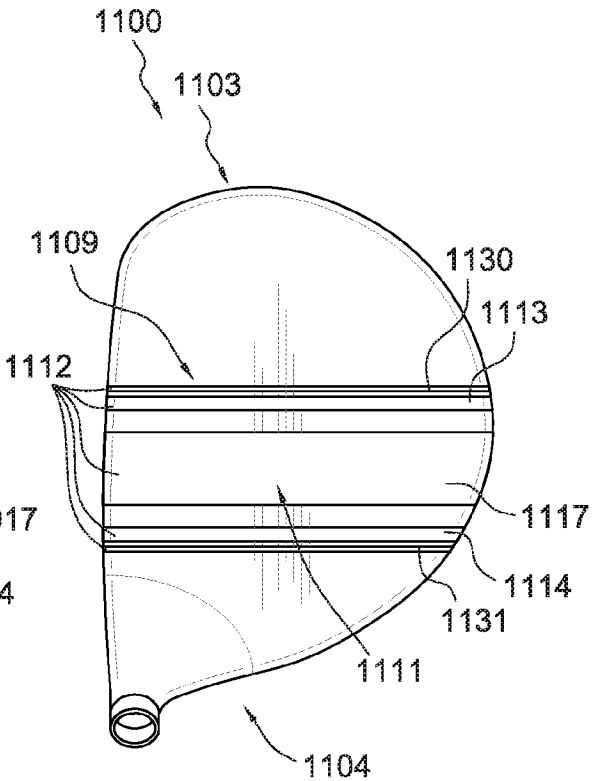
FIG. 11 illustrates another exemplary club head having an alignment aid of five stripes, according to the embodiment of FIG. 9.
Figure 12:
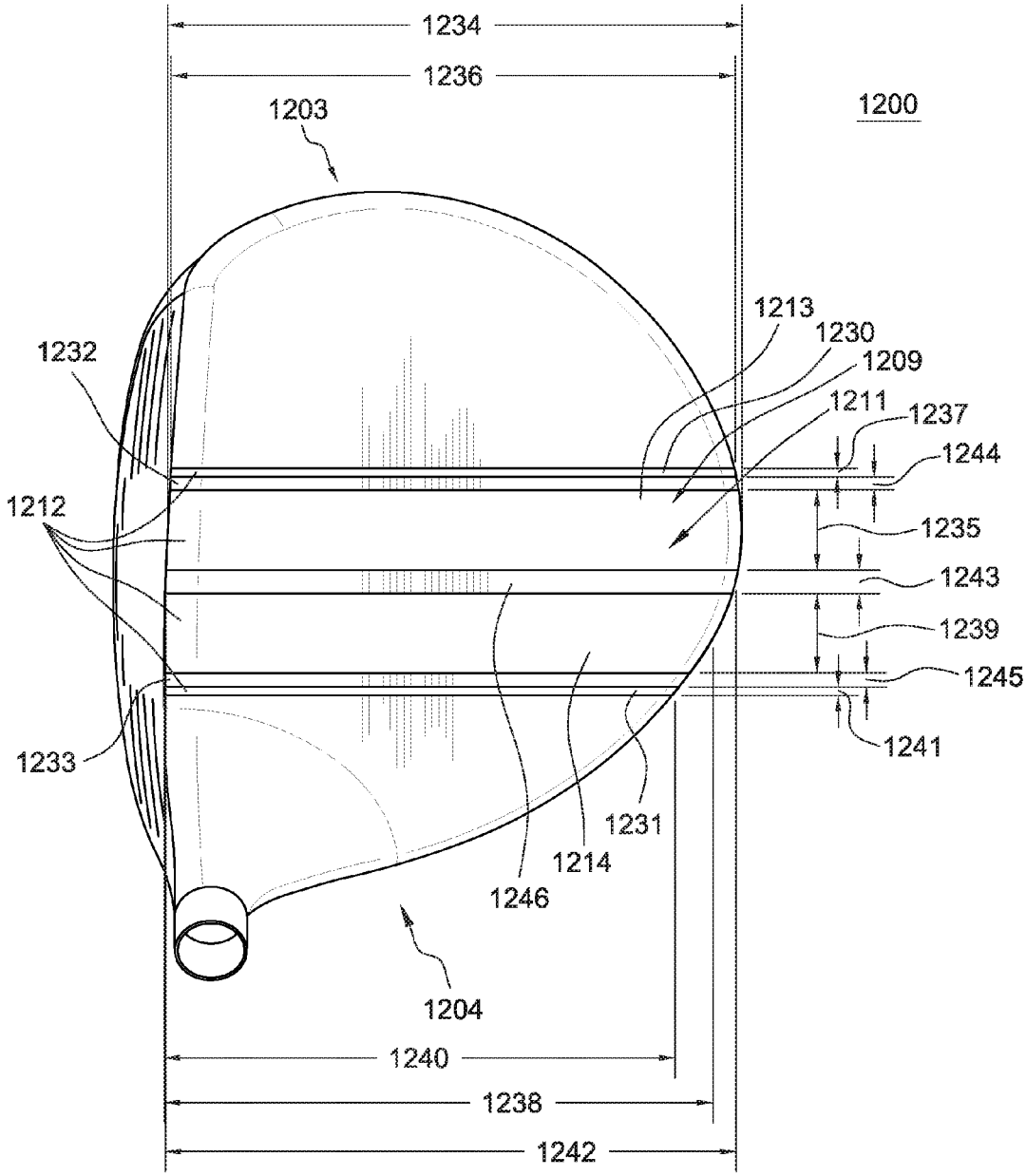
FIG. 12 illustrates another exemplary club head having an alignment aid of four stripes, according to another embodiment.

Referring to FIG. 7, method 700 can comprise procedure 701 of providing a club head. In many embodiments, the club head can be similar or identical to club head 100 (FIG. 1), club head 200 (FIG. 2), club head 300 (FIG. 3), club head 400 (FIG. 4), club head 900 (FIG. 9), club head 1000 (FIG. 10), club head 1100 (FIG. 11), and/or club head 1200 (FIG. 12).

Figure 8:
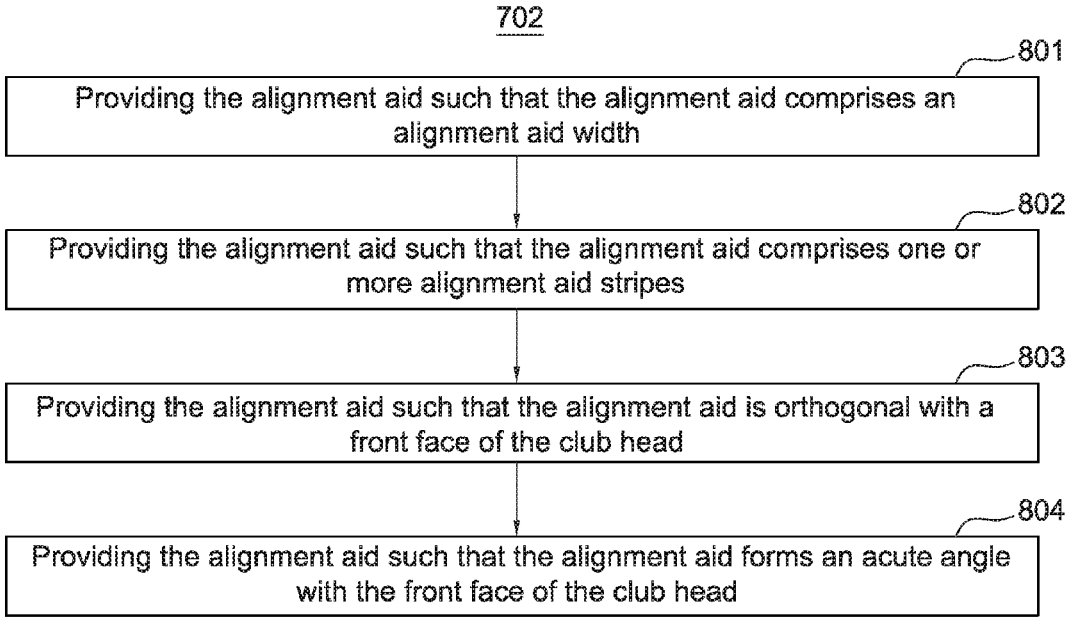
FIG. 8 illustrates a flow chart for an exemplary procedure of providing an alignment aid.

Method 700 can continue with procedure 702 of providing an alignment aid at a crown surface of the club head such that the alignment aid extends between a front crown end of the crown surface and a rear crown end of the crown surface. The alignment aid can be similar or identical to alignment aid 109 (FIG. 1), alignment aid 209 (FIG. 2), alignment aid 309 (FIG. 3), alignment aid 409 (FIG. 4), alignment aid 909 (FIG. 9), alignment 1009 (FIG. 10), alignment 1109 (FIG. 11), and/or alignment aid 1209 (FIG. 12). As an example, the crown surface can be similar or identical to crown surface 106 (FIG. 1), crown surface 206 (FIG. 2), crown surface 306 (FIG. 3), and/or crown surface 406 (FIG. 4). FIG. 8 illustrates an exemplary procedure 702 of providing the alignment aid, according to the embodiment of FIG. 7.

Referring to FIG. 8, procedure 702 can comprise process 801 of providing the alignment aid such that the alignment aid comprises an alignment aid width. As an example, the alignment aid width can be similar or identical to alignment aid width 110 (FIG. 1) and/or alignment aid width 210 (FIG. 2).

Procedure 702 can comprise process 802 of providing the alignment aid such that the alignment aid comprises one or more alignment aid stripes. The alignment aid stripe(s) can be similar or identical to alignment aid stripe(s) 111 (FIG. 1), alignment aid stripe(s) 211 (FIG. 2), alignment aid stripe(s) 911 (FIG. 9), alignment aid stripe(s) 1011 (FIG. 10), alignment aid stripe(s) 1111 (FIG. 11), and/or alignment aid stripe (s) 1211 (FIG. 12). In some embodiments, process 802 can comprise providing two alignment aid stripes. In further embodiments, process 802 can comprise providing three alignment aid stripes. In other embodiments, process 802 can comprise providing four alignment aid stripes. In still other embodiments, process 802 can comprise providing five alignment aid stripes. The two alignment aid stripes can be similar or identical to two alignment aid stripes 112 (FIG. 1); the three alignment aid stripes can be similar or identical to three alignment aid stripes 212 (FIG. 2); the four alignment aid stripes can be similar or identical to four alignment aid stripes 1212 (FIG. 12); and/or the five alignment aid stripes can be similar or identical to five alignment aid stripes 912 (FIG. 9), five alignment aid stripes 1012 (FIG. 10), and/or five alignment aid stripes 1112 (FIG. 11).

Procedure 702 can comprise process 803 of providing the alignment aid such that the alignment aid is orthogonal with a front face of the club head. As an example, the front face can be similar or identical to front face 105 (FIG. 1), front face 205 (FIG. 2), front face 305 (FIG. 3), and/or front face 405 (FIG. 4).

Procedure 702 can comprise process 804 of providing the alignment aid such that the alignment aid forms an acute angle with the front face of the club head. The acute angle can be similar or identical to acute angle 321 (FIG. 3) and/or acute angle 421 (FIG. 4). Procedures 801-804 can be performed in any order and/or simultaneously with each other.

Figure 9:
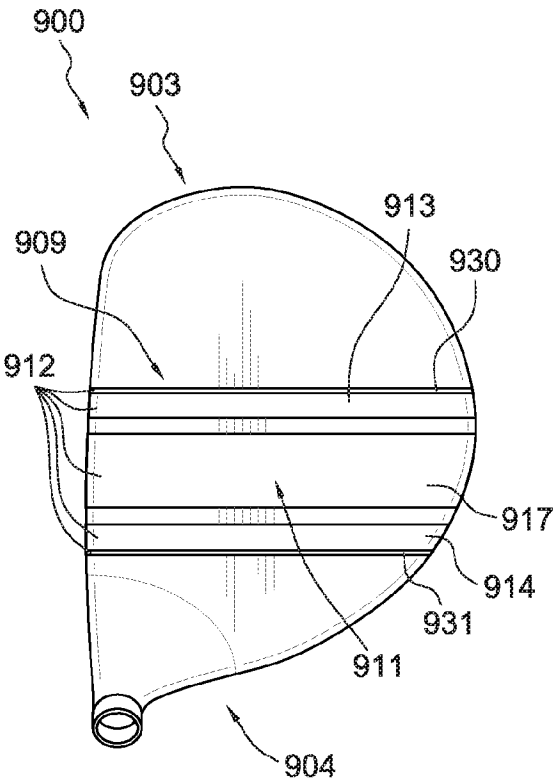
FIG. 9 illustrates another exemplary club head having an alignment aid of five stripes, according to another embodiment.

Returning again to the drawings, FIG. 9 illustrates a top view of an exemplary club head 900 where alignment aid stripe(s) 911 of alignment aid 909 comprise five alignment aid stripes 912, according to an embodiment. Club head 900 can be similar to club head 100 (FIG. 1), club head 200 (FIG. 2), club head 300 (FIG. 3), and/or club head 400 (FIG. 4). Accordingly, like numbered reference elements of club head 900 can be similar or identical to like numbered reference elements of club head 100, club head 200, club head 300, and/or club head 400.

Five alignment aid stripes 912 can comprise first toe alignment aid stripe 913, second toe alignment aid stripe 930, first heel alignment aid stripe 914, second heel alignment aid stripe 931, and center alignment aid stripe 917. Each of the five alignment aid stripes can be parallel to each other. First toe alignment aid stripe 913 is closer to toe end 903 than to heel end 904; second toe alignment aid stripe 930 is closer to toe end 903 than first toe alignment aid stripe 913; first heel alignment aid stripe 914 is closer to heel end 904 than to toe end 903; second heel alignment aid stripe 931 is closer to heel end 904 than first heel alignment aid stripe 914; and center alignment aid stripe 917 can be substantially equally between first toe alignment aid stripe 913 and first heel alignment aid stripe 914 and substantially equally between heel end 904 and toe end 903.

In some embodiments, first toe alignment aid stripe 913 can be tangent to or contiguous with second toe alignment aid stripe 930, and/or first heel alignment aid stripe 914 can be tangent to second heel alignment aid stripe 931, as illustrated in FIG. 9. In these embodiments, there is no gap between first and second toe alignment aid stripes 913 and 920, and there is no gap between first and second heel alignment aid stripes 914 and 931. Also in these embodiments, first toe alignment aid stripe 913 can comprise a different color (e.g., white, etc.) than second toe alignment aid stripe 930 (e.g., silver, gray, green, etc.), and/or first heel alignment aid stripe 914 can comprise a different color (e.g., white) than second heel alignment aid stripe 931 (e.g., silver, gray, green, etc.), such as, for example, to help users distinguish first toe alignment aid stripe 913 from second toe alignment aid stripe 930 and/or first heel alignment aid stripe 914 from second heel alignment aid stripe 931. Further in these embodiments, first toe alignment aid stripe 913 and first heel alignment aid stripe 914 can comprise the same color or different colors, and/or second toe alignment aid stripe 930 and second heel alignment aid stripe 931 can comprise the same color or different colors. Additionally in these embodiments, first toe alignment aid stripe 913, first heel alignment aid stripe 914, and center alignment aid stripe 917 can comprise the same color or different colors.

Center alignment aid stripe 917 can be wider than first toe alignment aid stripe 913 and first heel alignment aid stripe 914, which can be wider than second toe alignment aid stripe 930 and second heel alignment aid stripe 931. Also, first toe alignment aid stripe 913 and first heel alignment aid stripe 914 can be wider than the gap between first toe alignment aid stripe 913 and center alignment aid stripe 917 and the gap between first heel alignment aid stripe 914 and center alignment aid stripe 917. Furthermore, first toe alignment aid stripe 913 and first heel alignment aid stripe 914 can have the same width, and second toe alignment aid stripe 930 and second heel alignment aid stripe 931 can have the same width.

Figure 10:
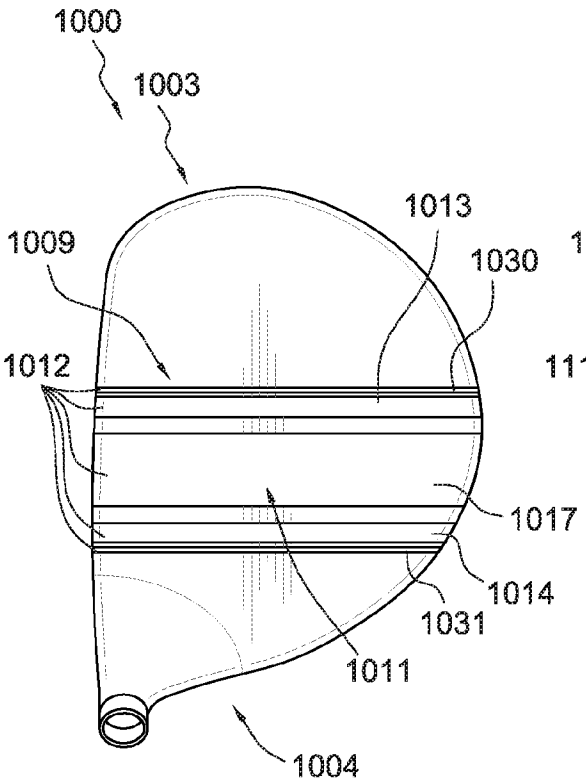
FIG. 10 illustrates another exemplary club head having an alignment aid of five stripes, according to the embodiment of FIG. 9.

Returning again to the drawings, FIG. 10 illustrates a top view of an exemplary club head 1000 where alignment aid stripe(s) 1011 of alignment aid 1009 comprise five alignment aid stripes 1012, according to an embodiment. Club head 1000 can be similar to club head 100 (FIG. 1), club head 200 (FIG. 2), club head 300 (FIG. 3), club head 400 (FIG. 4), and/or club head 900 (FIG. 9). Accordingly, like numbered reference elements of club head 900 can be similar or identical to like numbered reference elements of club head 100, club head 200, club head 300, club head 400, and/or club head 900.

Five alignment aid stripes 1012 can comprise first toe alignment aid stripe 1013, second toe alignment aid stripe 1030, first heel alignment aid stripe 1014, second heel alignment aid stripe 1031, and center alignment aid stripe 1017. Each of five alignment aid stripes 1012 can be parallel to each other. First toe alignment aid stripe 1013 is closer to toe end 1003 than to heel end 1004; second toe alignment aid stripe 1030 is closer to toe end 1003 than first toe alignment aid stripe 1013; first heel alignment aid stripe 1014 is closer to heel end 1004 than to toe end 1003; second heel alignment aid stripe 1031 is closer to heel end 1004 than first heel alignment aid stripe 1014; and center alignment aid stripe 1017 can be substantially equally between first toe alignment aid stripe 1013 and first heel alignment aid stripe 1014 and substantially equally between heel end 1004 and toe end 1003.

In these embodiments, first toe alignment aid stripe 1013 can be offset from second toe alignment aid stripe 1030, and/or first heel alignment aid stripe 1014 can be offset from second heel alignment aid stripe 1031, as illustrated in FIG. 10. Accordingly, a gap exists between first and second toe alignment aid stripes 1013 and 1030, and another gap exists between first and second heel alignment aid stripes 1014 and 1031. Meanwhile, in the same or different embodiments, first toe alignment aid stripe 1013 and/or first heel alignment aid stripe 1014 can be offset from center alignment aid stripe 1017. Accordingly, a gap exists between first toe alignment aid stripe 1013 and center alignment aid stripe 1017, and another gap exists between first heel alignment aid stripe 1014 and center alignment aid stripe 1017. First toe alignment aid stripe 1013 is wider than the gap between first toe alignment aid stripe 1013 and center alignment aid stripe 1017, which is wider than second toe alignment aid stripe 1030 and the gap between second alignment aid stripe 1030 and first toe alignment aid stripe 1013. Similarly, first heel alignment aid stripe 1014 is wider than the gap between first heel alignment aid stripe 1014 and center alignment aid stripe 1017, which is wider than second heel alignment aid stripe 1031 and the gap between second heel alignment aid stripe 1031 and first heel alignment aid stripe 1014. Also, first alignment aid stripe 1013 and first heel alignment aid stripe 1014 can have the same width, and second toe alignment aid stripe 1030 and second heel alignment aid stripe 1031 can have the same width.

Moving on in the drawings, FIG. 11 illustrates a top view of an exemplary club head 1100 where alignment aid stripe(s) 1111 of alignment aid 1109 comprise five alignment aid stripes 1112, according to an embodiment. Club head 1100 can be similar to club head 100 (FIG. 1), club head 200 (FIG. 2), club head 300 (FIG. 3), club head 400 (FIG. 4), club head 900 (FIG. 9), and/or club head 1000 (FIG. 10). Accordingly, like numbered reference elements of club head 900 can be similar or identical to like numbered reference elements of club head 100, club head 200, club head 300, club head 400, club head 900, and/or club head 1000.

Five alignment aid stripes 1112 can comprise first toe alignment aid stripe 1113, second toe alignment aid stripe 1130, first heel alignment aid stripe 1114, second heel alignment aid stripe 1131, and center alignment aid stripe 1117. Each of five alignment aid stripes 1112 can be parallel to each other. First toe alignment aid stripe 1113 is closer to toe end 1103 than to heel end 1104; second toe alignment aid stripe 1130 is closer to toe end 1103 than first toe alignment aid stripe 1113; first heel alignment aid stripe 1114 is closer to heel end 1104 than to toe end 1103; second heel alignment aid stripe 1131 is closer to heel end 1104 than first heel alignment aid stripe 1114; and center alignment aid stripe 1117 can be substantially equally between first toe alignment aid stripe 1113 and first heel alignment aid stripe 1114 and substantially equally between heel end 1104 and toe end 1103.

In these embodiments, first toe alignment aid stripe 1113 can be offset from second toe alignment aid stripe 1130, and/or first heel alignment aid stripe 1114 can be offset from second heel alignment aid stripe 1131, as illustrated in FIG. 11. Accordingly, a gap exists between first and second toe alignment aid stripes 1113 and 1130, and another gap exists between first and second heel alignment aid stripes 1114 and 1131. Meanwhile, in the same or different embodiments, first toe alignment aid stripe 1113 and/or first heel alignment aid stripe 1114 can be offset from center alignment aid stripe 1117. Accordingly, a gap exists between first toe alignment aid stripe 1113 and center alignment aid stripe 1117, and another gap exists between first heel alignment aid stripe 1114 and center alignment aid stripe 1117. The gap between first toe alignment aid stripe 1113 and center alignment aid stripe 1117 is wider than first two alignment aid stripe 113, which is wider than second toe alignment aid stripe 1130 and the gap between second toe alignment aid stripe 1030 and first toe alignment aid stripe 113. Similarly, the gap between first heel alignment aid stripe 1114 and center alignment aid stripe 1117 is wider than first heel alignment aid stripe 1114, which is wider than second heel alignment aid stripe 1131 and the gap between second heel alignment aid stripe 1131 and first heel alignment aid stripe 1114.

Turning to the next drawing, FIG. 12 illustrates a top view of an exemplary club head 1200 where alignment aid stripe(s) 1211 of alignment aid 1209 comprise four alignment aid stripes 1212, according to an embodiment. Club head 1200 can be similar to club head 100 (FIG. 1), club head 200 (FIG. 2), club head 300 (FIG. 3), club head 400 (FIG. 4), club head 900 (FIG. 9), club head 1000 (FIG. 10), club head 1100 (FIG. 11), and/or club head 1200 (FIG. 12). Accordingly, like numbered reference elements of club head 1200 can be similar or identical to like numbered reference elements of club head 100, club head 200, club head 300, club head 400, club head 900, club head 1000, club head 1100, and/or club head 1200.

Four alignment aid stripes 1212 can comprise first toe alignment aid stripe 1213, second toe alignment aid stripe

1230, first heel alignment aid stripe 1214, and second heel alignment aid stripe 1231. Each of four alignment aid stripes 1212 can be parallel to each other. First toe alignment aid stripe 1213 is closer to toe end 1203 than to heel end 1204; second toe alignment aid stripe 1230 is closer to toe end 1203 than first toe alignment aid stripe 1213; first heel alignment aid stripe 1214 is closer to heel end 1204 than to toe end 1203; and second heel alignment aid stripe 1231 is closer to heel end 1204 than first heel alignment aid stripe 1214.

Meanwhile, in some embodiments, first toe alignment aid stripe 1213 can be offset from second toe alignment aid stripe 1230 by toe offset region 1232, and/or first heel alignment aid stripe 1214 can be offset from second heel alignment aid stripe 1231 by heel offset region 1233. That is, a gap exists between first and second toe alignment aid stripes 1213 and 1230, and another gap exists between first and second heel alignment aid stripes 1214 and 1231. Furthermore, in these or other embodiments, first toe alignment aid stripe 1213 can be offset from first heel alignment aid stripe 1214 by center offset region 1246. Accordingly, a gap can also exist between first toe alignment aid stripe 1213 and first heel alignment aid stripe 1214.

In many embodiments, first toe alignment aid stripe 1213 can comprise first toe alignment aid stripe length 1234 (e.g., approximately 10.53 or 10.069 centimeters) and first toe alignment aid stripe width 1235 (e.g., approximately 1.486 centimeters). First toe alignment aid stripe length 1234 can be greater than or equal to approximately 8 centimeters and less than or equal to approximately 12 centimeters. First toe alignment aid stripe width 1235 can be greater than or equal to approximately 0.5000 centimeters and less than or equal to approximately 1.600 centimeters.

In many embodiments, second toe alignment aid stripe 1230 can comprise second toe alignment aid stripe length 1236 (e.g., approximately 10.35 or 9.383 centimeters) and second toe alignment aid stripe width 1237 (e.g., approximately 0.1520 centimeters). Second toe alignment aid stripe length 1236 can be greater than or equal to approximately 8.000 centimeters and less than or equal to approximately 12.00 centimeters. Second toe alignment aid stripe width 1237 can be greater than or equal to approximately 0.0500 centimeters and less than or equal to approximately 1.600 centimeters.

In many embodiments, first heel alignment aid stripe 1214 can comprise first heel alignment aid stripe length 1238 (e.g., approximately 10.53 or 10.069 centimeters) and first heel alignment aid stripe width 1239 (e.g., approximately 1.486 centimeters). First heel alignment aid stripe length 1238 can be greater than or equal to approximately 8 centimeters and less than or equal to approximately 12 centimeters. First heel alignment aid stripe width 1239 can be greater than or equal to approximately 0.5000 centimeters and less than or equal to approximately 1.600 centimeters.

In many embodiments, second heel alignment aid stripe 1231 can comprise second heel alignment aid stripe length 1240 (e.g., approximately 10.35 or 9.383 centimeters) and second heel alignment aid stripe width 1241 (e.g., approximately 0.1520 centimeters). Second heel alignment aid stripe length 1240 can be greater than or equal to approximately 8.000 centimeters and less than or equal to approximately 12.00 centimeters. Second heel alignment aid stripe width 1241 can be greater than or equal to approximately 0.0500 centimeters and less than or equal to approximately 1.600 centimeters.

In many embodiments, center offset region 1246 can comprise center offset region length 1242 (e.g., approximately 10.35 centimeters) and center offset region width 1243 (e.g., approximately 0.4064 centimeters). Center offset region length 1242 can be greater than or equal to approximately 8 centimeters and less than or equal to approximately 12 centimeters. Center offset region width 1243 can be greater than or equal to approximately 0.2000 centimeters and less than or equal to approximately 1.000 centimeters.

In some embodiments, toe offset region 1232 can comprise toe offset region width 1244, and/or heel offset region 1233 can comprise heel offset region width 1245. In many embodiments, each of toe offset region width 1244 and/or heel offset region width 1245 can be approximately equal to 0.2540 centimeters, or greater than or equal to approximately 0.1000 centimeters to less than or equal to approximately 0.3500 centimeters.

First toe alignment aid stripe width 1235 can be approximately equal to first heel alignment aid stripe width 1239, and second toe alignment aid stripe width 1237 can be approximately equal to second heel alignment aid stripe width 1241. In the same or different embodiments, first toe alignment aid stripe width 1235 can be different than second toe alignment aid stripe width 1237, and/or first heel alignment aid stripe width 1239 can be different than second heel alignment aid stripe width 1241. Furthermore, center alignment aid gap width 1243 can be different than first toe alignment aid stripe width 1235, first heel alignment aid stripe width 1239, second toe alignment aid stripe width 1237, and/or second heel alignment aid stripe width 1241. Each of first toe alignment aid stripe length 1234, second toe alignment aid stripe length 1236, first heel alignment aid stripe length 1238, second heel alignment aid stripe length 1240, and/or center alignment aid gap length 1242 can be measured at a midpoint of first toe alignment aid stripe width 1235, second toe alignment aid stripe width 1237, first heel alignment aid stripe width 1239, second heel alignment aid stripe width 1241, and/or center alignment aid gap width 1243, respectively.

Figure 13:
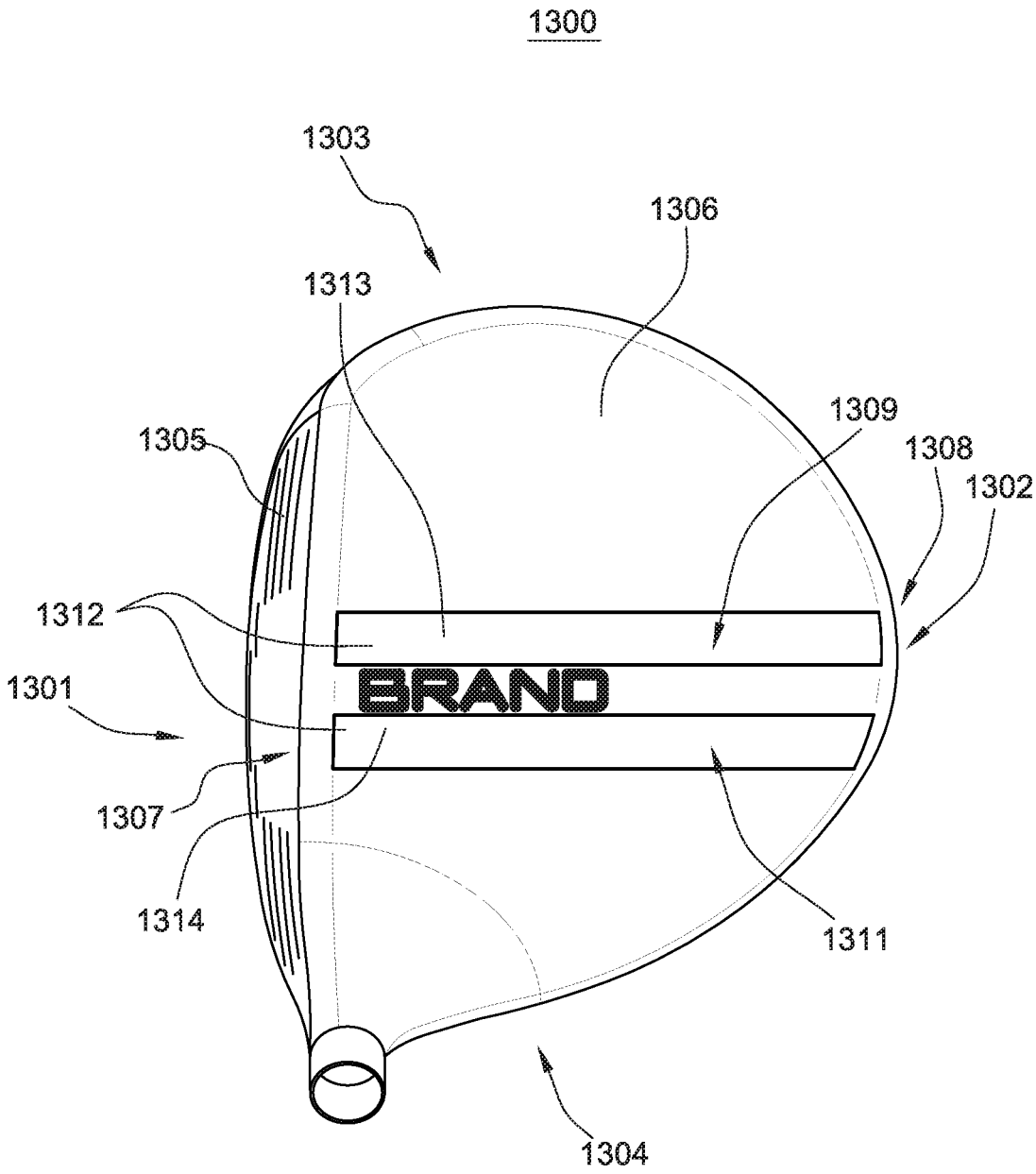
FIG. 13 illustrates a top view of an exemplary club head having an alignment aid of two stripes, according to another embodiment.

In many embodiments, any of club head 100 (FIG. 1), club head 200 (FIG. 2), club head 300 (FIG. 3), club head 400 (FIG. 4), club head 900 (FIGS. 9-11), club head 1200 (FIG. 12), and/or club head 1300 (FIG. 13) can comprise one or more branding and/or other symbols, such as, for example, to indicate a manufacturer of club head 100 (FIG. 1), club head 200 (FIG. 2), club head 900 (FIG. 9), club head 1000 (FIG. 10), club head 1100 (FIG. 11), club head 1200 (FIG. 12), and/or club head 1300 (FIG. 13) respectively. These branding and/or other symbols can overlap or can be separate from alignment aid 111 (FIG. 1), alignment aid 211 (FIG. 2), alignment aid 311 (FIG. 3), alignment aid 411 (FIG. 4), alignment aid 911 (FIG. 9), alignment aid 1011 (FIG. 10), alignment aid 1111 (FIG. 11), alignment aid 1211 (FIG. 12), and/or alignment aid 1311 (FIG. 13). As an example, in FIG. 12, a branding logo can be shown at first heel alignment aid stripe 1214 toward the rear of the crown of club head 1200. In other embodiments, the branding and/or other symbol(s) can be omitted.

Meanwhile, turning ahead in the drawings, FIG. 13 illustrates a top view of club head 1300, according to an embodiment. Club head 1300 is merely exemplary and is not limited to the embodiments presented herein. Club head 1300 can be employed in many different embodiments or examples not specifically depicted or described herein. Club head 1300 can be similar or identical to any of club head 100 (FIG. 1), club head 200 (FIG. 2), club head 300 (FIG. 3), club head 400 (FIG. 4), club head 900 (FIGS. 9-11), and/or club head 1200 (FIG. 12).

For example, club head 1300 can comprise front end 1301, rear end 1302, toe end 1303, heel end 1304, front face 1305, crown surface 1306, front crown end 1307, read crown end

1308, and alignment aid 1309. Further, alignment aid 1309 can comprise one or more alignment aid stripe(s) 1311, and alignment aid stripe(s) 1311 can comprise two alignment aid stripes 1312. Front end 1301, rear end 1302, toe end 1303, heel end 1304, front face 1305, crown surface 1306, front crown end 1307, read crown end 1308, and alignment aid 1309 can be similar or identical to front end 101, rear end 102, toe end 103, heel end 104, front face 105, crown surface 106, front crown end 107, read crown end 108, and alignment aid 109, respectively, in FIG. 1. Likewise, alignment aid stripe(s) 1311 and two alignment aid stripes 1312 can be similar or identical to alignment aid stripe(s) 111 and two alignment aid stripes 112, respectively, in FIG. 1. As an example, in FIG. 13, a branding logo is shown at the gap between two alignment aid stripes 1312.

Although the invention has been described with reference to specific embodiments, it will be understood by those skilled in the art that various changes may be made without departing from the spirit or scope of the invention. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that procedure 701 and 702 of FIG. 7 and processes 801 through 804 of FIG. 8 may be comprised of many different procedures, processes, and activities and be performed by many different modules, in many different orders, that any element of FIGS. 1-13 may be modified, and that the foregoing discussion of certain of these embodiments does not necessarily represent a complete description of all possible embodiments.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claim.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a wood-type golf club head, the apparatus, methods, and articles of manufacture described herein may be applicable to other types of golf clubs such as an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A driver club head comprising:
- a front end comprising a front face;
- a toe end;
- a heel end opposite the toe end;
- a rear end opposite the front end;
- a crown surface comprising a front crown end and a rear crown end; and
- an alignment aid at the crown surface;
- wherein:
  - the front crown end is closer to the front end than to the rear end;
  - the rear crown end is closer to the rear end than to the front end;
  - the alignment aid comprises two or more alignment aid stripes;
  - the two or more alignment aid stripes comprise a first alignment aid stripe and a second alignment aid stripe extending between the front crown end and the rear crown end;
  - the first alignment aid stripe is closer to the toe end than to the heel end;
  - the second alignment aid stripe is closer to the heel end than to the toe end;
  - the first alignment aid stripe is approximately parallel with the second alignment aid stripe;
  - the two or more alignment aid stripes comprise a first color;
  - the crown surface comprises a second color different from the first color;
  - the alignment aid comprises an alignment aid width;
  - the alignment aid width is less than or equal to a diameter of a golf ball;
  - the first and second alignment aid stripes of the two or more alignment aid stripes are offset from each other by a gap; and
  - the gap comprises the second color and a gap width greater than a width of any one of the first and second alignment aid stripes of the two or more alignment aid stripes.

2. The driver club head of claim 1 wherein:
- the two or more alignment aid stripes comprise at least one of: (a) varying or (b) approximately equal widths; and
- the alignment aid is located approximately equidistant between the toe end and the heel end.

3. The driver club head of claim 1 wherein:
- the crown surface comprises the alignment aid; and
- a word is located in the gap between the first alignment aid stripe and the second alignment aid stripe.

4. The driver club head of claim 3 wherein:
- the word is arranged in parallel with the two or more alignment aid stripes.

5. The driver club head of claim 1 wherein:
- the alignment aid is located approximately equidistant between the toe end and the heel end;
- a word is located in the gap between the two or more alignment aid stripes;
- the word is arranged in parallel with the two or more alignment aid stripes;
- the two or more alignment aid stripes are approximately parallel with each other; and the diameter of the golf ball is approximately 4.26 centimeters.

6. A wood-type club head comprising:

a front end comprising a front face;

a toe end;

a heel end opposite the toe end;

a rear end opposite the front end;

a crown surface comprising a front crown end and a rear crown end; and an alignment aid at the crown surface and between the front crown end and the rear crown end;

wherein:

the front crown end is closer to the front end than to the rear end;

the rear crown end is closer to the rear end than to the front end;

the alignment aid comprises two or more alignment aid stripes;

the two or more alignment aid stripes are non-collinear;

the two or more alignment aid stripes comprise a first color;

the crown surface comprises a second color different from the first color;

the alignment aid comprises an alignment aid width;

the alignment aid width is less than or equal to a diameter of a golf ball;

any two adjacent alignment aid stripes of the two or more alignment aid stripes are offset from each other by a gap;

each gap comprises the second color; and each gap comprises a gap width greater than a width of any one of the two or more alignment aid stripes.

7. The wood-type club head of claim 6 wherein at least one of:

the two or more alignment aid stripes comprise at least one of: (a) varying or (b) approximately equal widths; or the two or more alignment aid stripes are approximately parallel with each other.

8. The wood-type club head of claim 6 wherein:

the two or more alignment aid stripes are approximately parallel with each other.

9. The wood-type club head of claim 6 wherein:

the alignment aid comprises at least one graphic other than the two or more alignment aid stripes.

10. The wood-type club head of claim 6 wherein;

the alignment aid comprises each gap; and one gap comprises at least one graphic.

11. The wood-type club head of claim 6 wherein:

the two or more alignment aid stripes comprise a first alignment aid stripe and a second alignment aid stripe;

the first alignment aid stripe is closer to the toe end than the heel end; and the second alignment aid stripe is closer to the heel end than the toe end.

12. The wood-type club head of claim 6 wherein:

the diameter of the golf ball is approximately 4.26 centimeters; and the alignment aid width is less than the diameter of the golf ball.

13. The wood-type club head of claim 6 wherein:

the alignment aid comprises at least one graphic aligned with the two or more alignment aid stripes such that the alignment aid is substantially linear; and the alignment aid is integral with the wood-type club head.

14. The wood-type club head of claim 6 wherein:

the alignment aid is located approximately equidistant between the toe end and the heel end.

15. A wood-type club head comprising:

a front end comprising a front face;

a toe end;

a heel end opposite the toe end;

a rear end opposite the front face;

a crown surface comprising a front crown end and a rear crown end; and an alignment aid at the crown surface and between the front crown end and the rear crown end;

wherein:

the front crown end is closer to the front end than to the rear end;

the rear crown end is closer to the rear end than to the front end;

the alignment aid comprises an alignment aid width, the alignment aid width being less than or equal to a golf ball diameter of a golf ball;

the alignment aid comprises two or more alignment aid stripes;

the two or more alignment aid stripes are approximately parallel with each other;

any two adjacent alignment aid stripes of the two or more alignment aid stripes are offset from each other by a gap; and each gap comprises a gap width greater than a width of any one of the two or more alignment aid stripes.

16. The wood-type club head of claim 15 wherein:

the two or more alignment aid stripes comprise a first color;

the crown surface comprises a second color different from the first color; and the alignment aid comprises each gap and text located at an end of the alignment aid.

17. The wood-type club head of claim 15 wherein:

the two or more alignment aid stripes comprise at least one of: (a) varying or (b) approximately equal widths; and the alignment aid is approximately equidistant between the toe end and the heel end.

18. The wood-type club head of claim 15 wherein:

the crown surface comprises the alignment aid.

19. The wood-type club head of claim 15 wherein:

the alignment aid forms an acute angle with the front face;

the acute angle opens toward one of the toe end or the heel end; and the acute angle is greater than or equal to approximately 45 degrees and less than approximately 90 degrees.

20. The wood-type club head of claim 15 wherein:

the golf ball diameter of the golf ball is approximately 4.26 centimeters.

* * * * *